US006589192B2

(12) United States Patent
Chan et al.

(10) Patent No.: US 6,589,192 B2
(45) Date of Patent: Jul. 8, 2003

(54) DEEP TISSUE MASSAGE MACHINE

(76) Inventors: King Yiu Chan, 16286 SW. Horseshoe Way, Beaverton, OR (US) 97007; Si Ming Du, 16286 SW. Horseshoe Way, Beaverton, OR (US) 97007

( * ) Notice: Subject to any disclaimer, the term of this patent is extended or adjusted under 35 U.S.C. 154(b) by 0 days.

(21) Appl. No.: 09/939,143

(22) Filed: Aug. 27, 2001

(65) Prior Publication Data

US 2003/0040689 A1 Feb. 27, 2003

(51) Int. Cl.[7] ..... A61H 15/00

(52) U.S. Cl. ..... 601/113; 601/113; 601/127; 601/134

(58) Field of Search ..... 601/134, 118, 601/129, 94, 122, 145, 97, 98, 99, 100, 101, 102, 103, 121, 112, 115, 116, 113, 126, 127

(56) References Cited

U.S. PATENT DOCUMENTS

| | | | | | |
|---|---|---|---|---|---|
| 4,016,872 | A | * | 4/1977 | Yamamura et al. | 601/118 |
| 4,506,660 | A | * | 3/1985 | Curran | 601/127 |
| 4,716,891 | A | * | 1/1988 | Yorgan | 601/127 |
| 5,088,475 | A | * | 2/1992 | Steffensmeier | 601/116 |
| 5,183,034 | A | * | 2/1993 | Yamasaki et al. | 601/70 |
| 5,356,369 | A | * | 10/1994 | Yamasaki et al. | 601/70 |
| 5,667,482 | A | * | 9/1997 | Cheng | 601/112 |
| 5,772,614 | A | * | 6/1998 | Lindquist | 601/116 |
| 5,792,080 | A | * | 8/1998 | Ookawa et al. | 601/115 |
| 6,056,709 | A | * | 5/2000 | Hashimoto | 601/127 |
| 6,196,984 | B1 | * | 3/2001 | Hashimoto | 601/122 |
| 6,210,349 | B1 | * | 4/2001 | Naruse et al. | 601/127 |
| 6,224,563 | B1 | * | 5/2001 | Nonoue et al. | 601/99 |
| 6,387,063 | B1 | * | 5/2002 | Elnar | 601/99 |
| 2001/0011160 | A1 | * | 8/2001 | Oguma et al. | 601/89 |

FOREIGN PATENT DOCUMENTS

| | | | | |
|---|---|---|---|---|
| WO | WO 9104001 | A1 * | 4/1991 | A61H/15/00 |

* cited by examiner

*Primary Examiner*—Nicholas D. Lucchesi
*Assistant Examiner*—Fenn C Mathew
(74) *Attorney, Agent, or Firm*—James D. Givnan, Jr.

(57) ABSTRACT

The machine includes a platform for floor placement with the platform defining an open area for access to machine components. In place on the platform is a gearhead motor for driving a shaft journaled on the platform and provided with massage fingers for rotation about the shaft axis. The number and configuration of massage fingers may be selected for the massage task at hand. A pliable elastic sheet of material overlies the fingers and is attached to the platform in a removable manner.

10 Claims, 2 Drawing Sheets

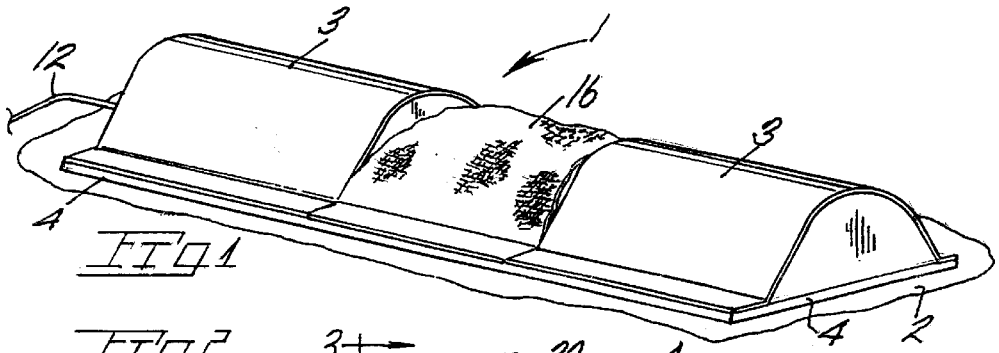
FIG. 1
FIG. 2
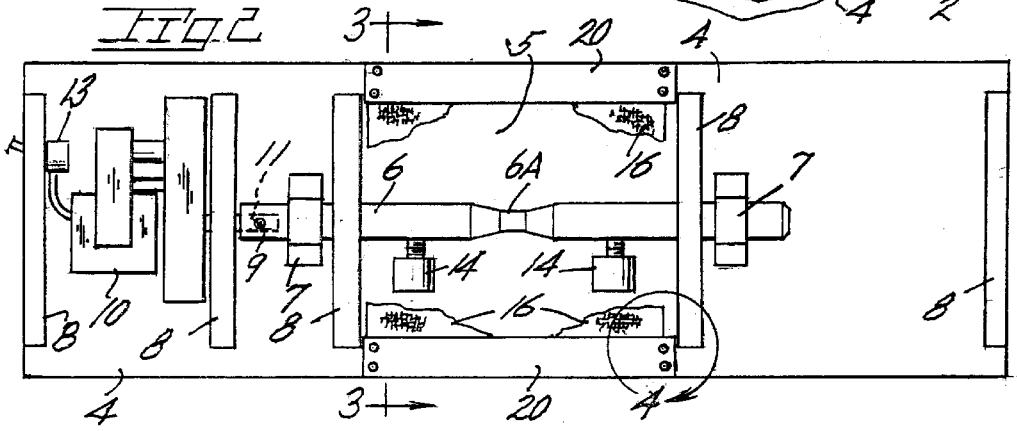
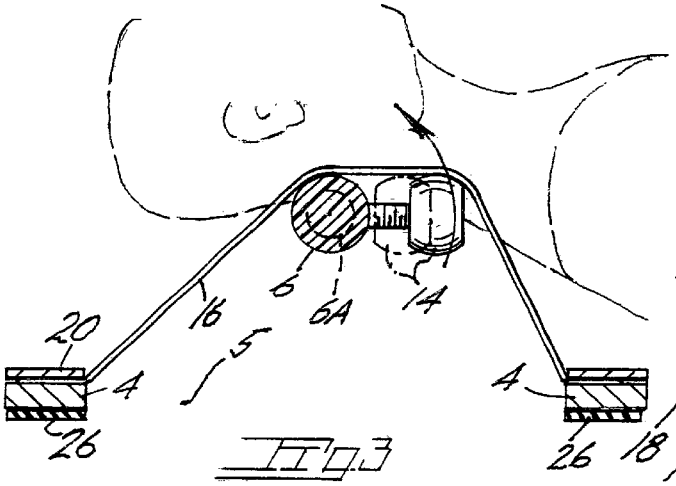
FIG. 3
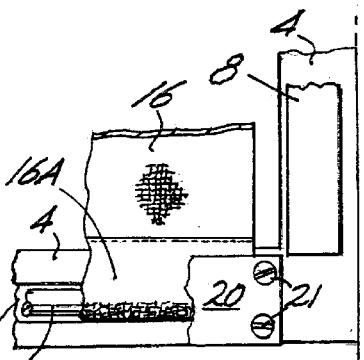
FIG. 4

DEEP TISSUE MASSAGE MACHINE

BACKGROUND OF THE INVENTION

The present machine concerns that field of massage equipment directed toward accomplishing a deep tissue massage by simulating the action of human hands.

Massage of muscles of the human body is accepted as having therapeutic benefits. Depending upon the ailment, it may be highly desirable to accomplish massage of large muscle tissue remote from the surface of the body, with such a massage being termed in the trade a deep tissue massage. Deep tissue massage is best accomplished by the human hand having requisite strength for manipulation of back and neck muscle tissues with greater manual effort than massages affecting only surface areas of the body.

Various efforts to simulate manual massages have resulted in a number of massage machines being the subject of prior patents. While such machines may have certain advantages, it is noted generally that the complexity of same renders them impractical for individual ownership. Their high cost and machine operation render them suitable only for clinics and the like. Complex machines obviously do not lend themselves to alteration by the user to best suit individual requirements in view of the degree of mechanical skill required to alter same.

In the prior art, U.S. Pat. No. 1,557,417 discloses a massage device having a circular array of ball elements which travel about a central axis while in rolling contact with the patient.

U.S. Pat. No. 5,165,390 discloses a surface for supporting a reclined human body and having massage elements, shown as spheres, propelled beneath a flexible pad with the spheres moving lengthwise along the patient's back. A trolley carrying the spheres includes a motor for positioning the spheres relative one another to suit different patients.

U.S. Pat. No. 6,200,282 discloses a chair structure with a chair back serving to house a pair of rails which carry a support block from which projects pairs of massage members which travel along the patient's back from the shoulder area to the lower back. The pairs of body massage members may be positioned toward one another about horizontal axes with provision also made for relocating the contacting members toward and away from a center line of the machine. The machine is of complex construction and not highly practical for individual ownership and operation.

U.S. Pat. No. 6,224,563 also discloses a chair structure having pairs of massaging elements for travel along a patient's back with provision made for actuating the sets of rollers for each set positionable about a horizontal axis to apply different degrees of pressure to the patients back. The remarks applied to the immediately foregoing patented device also apply to the machine disclosed in the last mentioned patent.

SUMMARY OF THE PRESENT INVENTION

The present invention is concerns a massage machine for temporary placement on a floor surface for use in massaging neck and shoulder muscles.

The present machine includes a platform for placement on a floor surface, preferably carpeted, permitting the user on the floor surface to position the neck and shoulder muscles for contact with massaging fingers of the machine. The massaging fingers are carried in an adjustable manner by a shaft of the machine powered by a gear head motor. A platform opening permits ready access to the shaft and the massage fingers thereon to change the number and/or configuration of the fingers to best suit the task at hand. A pliable sheet of material is disposed between the massage fingers and the body and may be replaced or changed for various purposes. Retention means secures the pliable sheet to the machine platform.

Important objectives of the present machine include the provision of a machine of modest cost of manufacture resulting in a massage machine which may be priced at an acceptable level for ownership by individual users; the provision of a massage machine, the operation of which is readily understood by the consumer without complicated instructions as to machine operation and use; the provision of a massage machine having a driven shaft member which may be readily modified by the substitution of massage fingers thereon and the number of same to achieve optimum effects on deep tissue areas of the human body; the provision of a massage machine having a powered shaft highly accessible to the user for convenient modification of the shaft by altering the number or the configuration of massage fingers thereon; the provision of a massage machine having massage fingers which are readily changeable to provide larger or smaller fingers to vary massage pressure on the body and to provide massage fingers adjustable relative a shaft axis to vary their effect on the users body.

BRIEF DESCRIPTION OF THE DRAWINGS

In the accompanying drawings:

FIG. 1 is a perspective view of the present machine;

FIG. 2 is a plain view of FIG. 1 with a housing component and a pliable sheet removed;

FIG. 3 is a sectional view taken along line 3—3 of FIG. 2 and illustrating application of the machine to a portion of the human body and the adjusted positioning of a finger relative the axis of a supporting shaft.

FIG. 4 is an enlarged detail view of the structure encircled at 4 in FIG. 2;

DETAILED DESCRIPTION OF THE PREFERRED EMBODIMENTS

Figure 5:
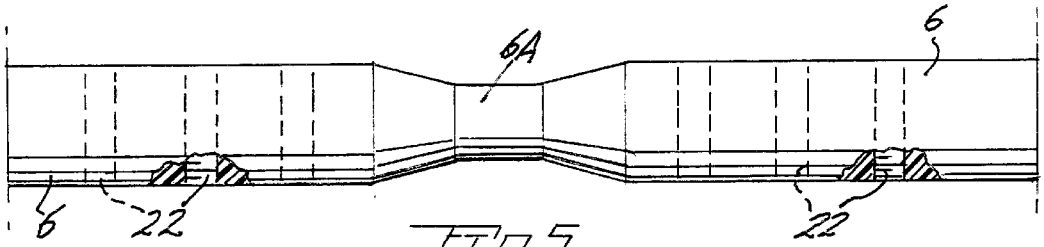
FIG. 5 is an enlarged fragmentary view of a powered shaft of the machine.

With continuing attention to the accompanying drawings wherein applied reference numerals indicate parts similarly hereinafter identified, the reference numeral 1 indicates generally the present machine in place on a floor or supporting surface 2. A housing is indicated at 3 suitably mounted in place on platform 4.

With attention specifically to FIG. 2, the platform 4 defines an opening 5 of several square inches in size permitting manual access, upon inverting of the machine, to a powered shaft 6, or at least a segment of the shaft several inches in length. Shaft 6 is carried in bearings 7 in place on the upper side of the platform when the machine is operatively disposed. Additionally in place on the platform are upright housing supports at 8. One of said housing supports additionally serves as a motor mount for a gear head motor 10 having an output shaft 11 in driving connection with shaft 6 as by a set screw 9 in abutment with a flat surface of the output shaft. Motor 10 is of the low speed high torque capability powered by a 115 volt AC source provided by a power line or cord 12 via a switch 13. One suitable motor provides approximately 125 inch pounds of torque with gear reduction component providing approximately 6 RPM. Accordingly, shaft 6 is driven at a low speed, for example 6 RPM, to cause massage fingers at 14 to orbit in the manner per the arrow in FIG. 3, the shaft axis and act on the neck and back muscles in a beneficial manner.

Superimposed over massage fingers 14 is a pliable sheet 16 in the preferred form of the invention. The pliable sheet at 16 has end segments typically shown in FIG. 4 secured to the platform by sleeve portions 16A stitched to form tubular ends to receive a retainer rod 17 extending lengthwise thereof. A groove 18 formed in the platform receives the sleeve portion of the pliable sheet with the retainer rod 17 therein, both inset into the groove 18 and retained therein by a retainer plate 20 secured as at 21 by fasteners. Suitable material for the pliable sheet is that fabric manufactured and sold under the Registered Trademark LYCRA, which is a fabric which may stretch in multiple directions and of a very durable nature. The sheet of material 16 is dimensioned to stretch while permitting forceful action of a massage finger or fingers with the body. Use of an elastic sheet member permits such forceful action of a finger 14 on a body while avoiding any abrasion of the latter.

Figure 6:
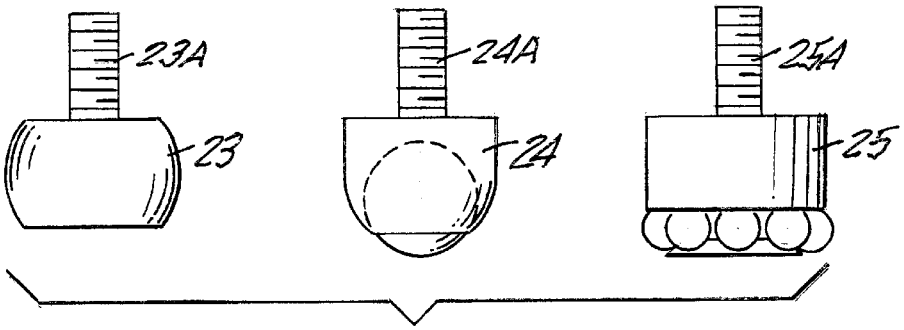
FIG. 6 is a view of an array of some massage fingers for installation on the powered shaft.

With attention to FIGS. 5 and 6, it will be seen that shaft 6 is drilled and tapped as at 22 at lengthwise spaced apart locations for the purpose of permitting attachment of threaded studs 14A of massage fingers 14 at selected points therealong in row fashion or rotationally offset about the shaft axis. An array of massage fingers is shown in FIG. 6 at 23, 24 and 25, each fitted with a threaded stud at 23A, 24A and 25A for screwed engagement with the shaft 6. While FIG. 2 shows two massage fingers placed on one side of shaft 6, in some instances the fingers will be oppositely located at spaced apart points along shaft 6, as for example, when the patient's upper back area is to be massaged. A resilient pad at 26 on the underside of platform 4 contributes to retention of the machine on a floor surface 2, preferably a rug or carpet, and in the absence of either permits the platform to yield in a limited manner to modulate the action of the massage fingers on the body.

In operation of the present machine, the user lies on his or her back on an adjacent surface of floor 2, preferably carpeted, with head and neck in rested placement upon shaft 6. A relieved area 6A of the shaft permits the head and neck to rest in supported placement on fingers 14 during arcuate passage past the head and neck. The weight of the user's head and neck assures biased effective action of the massage fingers preferably isolated from direct contact by pliable sheet 16. A pillow (not shown) may be placed between the user's shoulders and floor surface 2 or between the user's head and a floor surface when the shoulders are to be massaged to partake of some of the support of the user's upper torso. A suitable material for shaft 6 and massage fingers 14 is a synthetic, high density plastic manufactured and sold under the Trademark DELRIN.

While we have shown but a few embodiments of the invention, it will be apparent to those skilled in the art that the invention may be embodied still otherwise without departing from the spirit and scope of the claimed invention.

Having thus described the invention, what is desired to be secured by a Letters Patent is:

I claim:

1. A machine for massaging the neck and shoulder muscles of a person and comprising, a platform, a shaft journaled on said platform, means for powering said shaft, fingers positioned along said shaft for orbital travel in a path for applying pressure to the neck and shoulder muscles of the human body, said platform defining an opening adjacent a segment of said shaft enabling access to the shaft and fingers thereon, finger mounting means for selective placement of the fingers along said shaft, a pliable sheet overlying said fingers and having end segments, and retention means for securing the end segments to said platform.

2. The machine claimed in claim 1 wherein said finger mounting means includes threaded bores in said shaft and threaded studs on said fingers.

3. The machine claimed in claim 1 wherein said retention means includes plates removably attached to said platform.

4. The machine claimed in claim 1 wherein said platform defines a groove, a retainer carried by at least one of said end segments and seated in said groove.

5. The machine claimed in said pliable sheet is elastic and stretched along multiple axes during machine operation.

6. The machine claimed in claim 1 wherein said opening defined by the platform is of several square inches in area to permit manual access to said shaft.

7. The machine claimed in 1 wherein said shaft has a segment of reduced cross section located between two of said fingers to receive the user's neck.

8. The machine claimed in claim 1 wherein said finger mounting means permits positioning of said fingers at selected spaced apart intervals along said shaft and toward or away from the major axis of said shaft to very the orbital travel of the fingers.

9. A machine for massaging the neck and shoulder muscles of a person and comprising, a platform, a shaft journaled on said platform, means for powering said shaft, fingers positioned along said shaft for orbital travel in a path for applying pressure to the neck and shoulder muscles of the human body, finger mounting means for attachment of the fingers along said shaft, an elastic sheet overlying said fingers and having end segments, and retention means for securing the end segments to said platform, said shaft having a segment of reduced cross-section located between two of said fingers to receive the user's neck.

10. A machine for massaging the neck and shoulder muscles of a person and comprising, a platform, a shaft journaled on said platform, means for powering said shaft, fingers positioned along said shaft for orbital travel in a path for applying pressure to the neck and shoulder muscles of the human body, finger mounting means for attachment of the fingers along said shaft, said platform defining an opening of an area of several square inches to permit manual access to said shaft and the fingers positioned therealong, an elastic sheet overlying said fingers and having end segments, and retention means for securing the end segments to said platform.

* * * * *